US010018420B2

(12) United States Patent
Sasaki

(10) Patent No.: US 10,018,420 B2
(45) Date of Patent: Jul. 10, 2018

(54) METAL WIRE HEAT TREATMENT METHOD USING HEAT TREATMENT JIG

(71) Applicant: Canon Denshi Kabushiki Kaisha, Chichibu-shi (JP)

(72) Inventor: Koji Sasaki, Kyoto (JP)

(73) Assignee: CANON DENSHI KABUSHIKI KAISHA, Chichibu-Shi (JP)

( * ) Notice: Subject to any disclaimer, the term of this patent is extended or adjusted under 35 U.S.C. 154(b) by 0 days.

(21) Appl. No.: 15/822,767

(22) Filed: Nov. 27, 2017

(65) Prior Publication Data

US 2018/0080713 A1 Mar. 22, 2018

Related U.S. Application Data

(60) Division of application No. 14/310,142, filed on Jun. 20, 2014, which is a continuation of application No. PCT/JP2013/051372, filed on Jan. 24, 2013.

(30) Foreign Application Priority Data

Jan. 27, 2012 (JP) ..... 2012-014905

(51) Int. Cl.

| | |
|---|---|
| ***F27D 5/00*** | (2006.01) |
| ***B65H 75/02*** | (2006.01) |
| ***C21D 9/52*** | (2006.01) |
| ***C21D 9/00*** | (2006.01) |
| ***C22F 1/14*** | (2006.01) |

(Continued)

(52) U.S. Cl.

CPC ..... *F27D 5/00* (2013.01); *B65H 75/025* (2013.01); *C21D 9/0025* (2013.01); *C21D 9/525* (2013.01); *C22F 1/00* (2013.01); *C22F 1/02* (2013.01); *C22F 1/14* (2013.01); *F27D 2005/0081* (2013.01)

(58) Field of Classification Search

CPC ..... C21D 9/0025

See application file for complete search history.

(56) References Cited

U.S. PATENT DOCUMENTS

| | | | |
|---|---|---|---|
| 4,258,906 | A | 3/1981 | Lippmaa et al. |
| 5,645,558 | A | 7/1997 | Horton |

(Continued)

FOREIGN PATENT DOCUMENTS

| | | | |
|---|---|---|---|
| CN | 201971866 | U | 9/2011 |
| CN | 202297682 | U | 7/2012 |

(Continued)

OTHER PUBLICATIONS

International Search Report in International Application No. PCT/JP2013/051372 (dated Mar. 19, 2013).

(Continued)

*Primary Examiner* — Christopher Kessler

(74) *Attorney, Agent, or Firm* — Fitzpatrick, Cella, Harper & Scinto

(57) ABSTRACT

The present invention provides a heat treatment jig. A metal wire as a heat treatment target is to be wound around the jig. The jig comprises a cylindrical tubular body whose outer wall surface has a helical groove formed along a circumferential direction to wind the metal wire. A depth of the groove is larger than a length at which the metal wire will isolate from the groove when the metal wire wound along the groove at room temperature is thermally expanded by being heated to a predetermined heat treatment temperature.

5 Claims, 4 Drawing Sheets

(51) Int. Cl.

| | |
|---|---|
| ***C22F 1/02*** | (2006.01) |
| ***C22F 1/00*** | (2006.01) |

(56) References Cited

U.S. PATENT DOCUMENTS

| | | | |
|---|---|---|---|
| 5,660,541 | A | 8/1997 | Woolf et al. |
| 2012/0115733 | A1 | 5/2012 | Husband et al. |
| 2013/0213536 | A1 | 8/2013 | Yamashita |

FOREIGN PATENT DOCUMENTS

| | | | |
|---|---|---|---|
| EP | 2 628 815 | A1 | 8/2013 |
| JP | 50-93214 | A | 7/1975 |
| JP | 1-107503 | A | 4/1989 |
| JP | 8-176678 | A | 7/1996 |
| JP | 2009-228074 | A | 10/2009 |
| JP | 4691740 | B1 | 6/2011 |
| WO | 2010/119982 | A1 | 10/2010 |

OTHER PUBLICATIONS

Written Opinion in International Application No. PCT/JP2013/051372 (dated Mar. 19, 2013).
Office Action in Chinese Application No. 201380006616.3 (dated Feb. 28, 2015).

METAL WIRE HEAT TREATMENT METHOD USING HEAT TREATMENT JIG

This application is a divisional application of U.S. patent application Ser. No. 14/310,142, filed Jun. 20, 2014, which is a continuation application of International Patent Application No. PCT/JP2013/051372, filed Jan. 24, 2013, which claims priority to Japanese Patent Application No. 2012-014905, filed Jan. 27, 2012. The entire contents of all prior applications are incorporated herein by reference.

BACKGROUND OF THE INVENTION

Field of the Invention

The present invention relates to a heat treatment jig used to wind a metal wire such as a silver wire as a heat treatment target around it when heating the metal wire in a heat treating furnace, and a metal wire heat treatment method using the heat treatment jig.

Description of the Related Art

Conventionally, heat treatments for applying necessary heating and cooling operations in order to improve the quality of a metal material are widely performed. In general, when a metal material is heated, lattice defects (holes, interstitial atoms, dislocation, stacking faults, grain boundaries, and the like) in the material recover. Additionally, recrystallization occurs, and recrystallized grains grow. The quality of a metal material is also improved by phase transformation or deposition caused by a heat treatment. As examples of such a heat treatment of a metal material, International Patent Publication No. 10/119982 and Japanese Patent No. 4691740 disclose a technique of heating a metal wire such as a silver wire in a predetermined atmosphere so as to coarsen recrystallized grains, thereby giving a high electrical conduction efficiency to the metal wire.

In the heat treatment techniques disclosed in International Patent Publication No. 10/119982 and Japanese Patent No. 4691740, a metal wire is wound around a quartz tube and heated. However, it was found that neighboring metal wires heated to a high temperature adhere to each other in this case. Especially when the metal wire winding pitch is reduced to obtain a high production efficiency, such adhesion occurs in many portions. When the metal wires adhere to each other, they cannot be used as wires.

SUMMARY OF THE INVENTION

The present invention provides a heat treatment jig capable of preventing adhesion of metal wires at the time of heat treatment, and a metal wire heat treatment method using the heat treatment jig.

According to the first aspect of the present invention, there is provided a heat treatment jig around which a metal wire as a heat treatment target is to be wound, comprising a cylindrical tubular body whose outer wall surface has a helical groove formed along a circumferential direction to wind the metal wire, wherein a depth of the groove is larger than an length at which the metal wire will isolate from the groove thermally expand out from the groove when the metal wire wound along the groove at room temperature is thermally expanded by being heated to a predetermined heat treatment temperature.

According to the second aspect, in the heat treatment jig according to the first aspect, the tubular body is made of alumina or silica.

According to the third aspect, a metal wire heat treatment method comprises a winding step of winding a metal wire along a groove of a heat treatment jig according to the first or second aspect, and a heating step of installing the heat treatment jig with the metal wire wound in a heat treating furnace and heating the metal wire to a predetermined heat treatment temperature.

According to the fourth aspect, in the metal wire heat treatment method according to the third aspect, the metal wire comprises a silver wire.

The heat treatment jig according to the first and second aspects includes the tubular body whose outer wall surface has a helical groove formed to wind the metal wire. For this reason, the metal wires wound along the groove do not come into contact with each other even at the time of heat treatment. It is therefore possible to prevent the metal wires from adhering to each other at the time of heat treatment. In particular, the depth of the groove is larger than a length at which the metal wire will be isolated from the groove when the metal wire wound along the groove at room temperature is thermally expanded by being heated to a predetermined heat treatment temperature. This makes it possible to reliably prevent the metal wire thermally expanded at the time of heat treatment from disengaging from the groove and adhering to the neighboring metal wire.

In the metal wire heat treatment method according to the third and fourth aspects, the metal wire is wound along the groove of the heat treatment jig according to the first or second aspect and heated to the predetermined heat treatment temperature. The metal wires heated to the heat treatment temperature do not come into contact with each other. It is therefore possible to prevent the metal wires from adhering to each other at the time of heat treatment.

Further features of the present invention will become apparent from the following description of exemplary embodiments (with reference to the attached drawings).

DESCRIPTION OF THE EMBODIMENTS

An embodiment of the present invention will now be described in detail with reference to the accompanying drawings.

Figure 1:
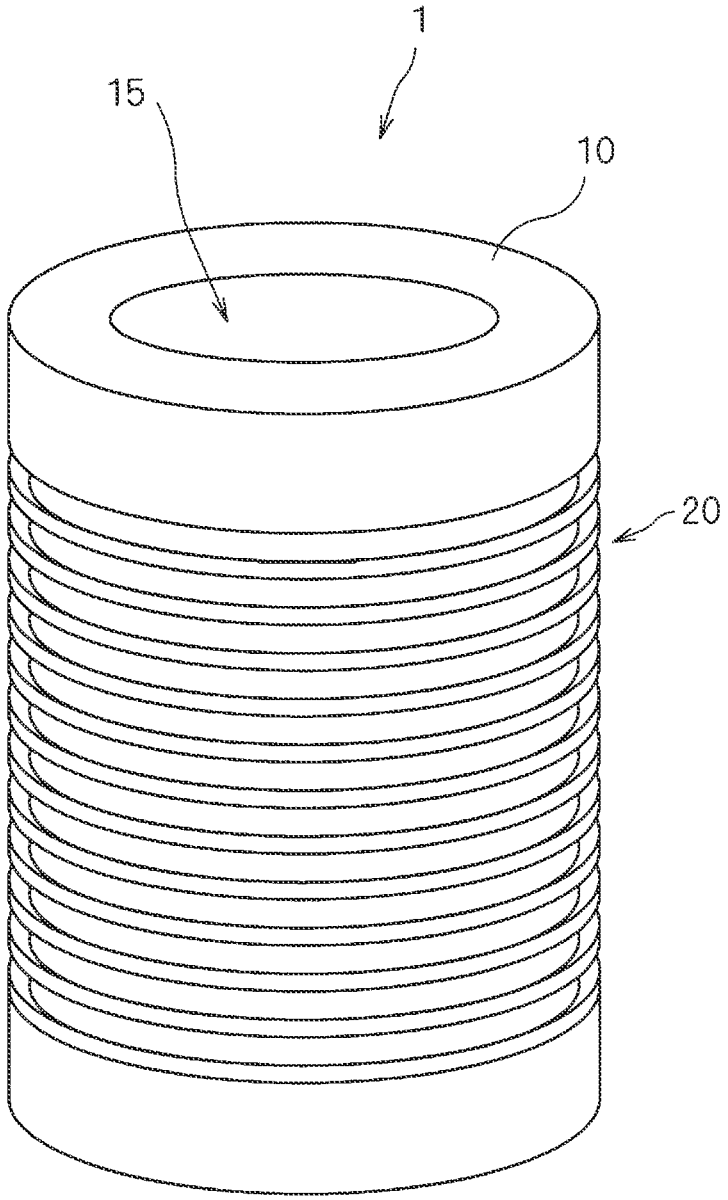
FIG. 1 is a perspective view showing the overall outer appearance of a heat treatment jig according to the present invention.
Figure 2:
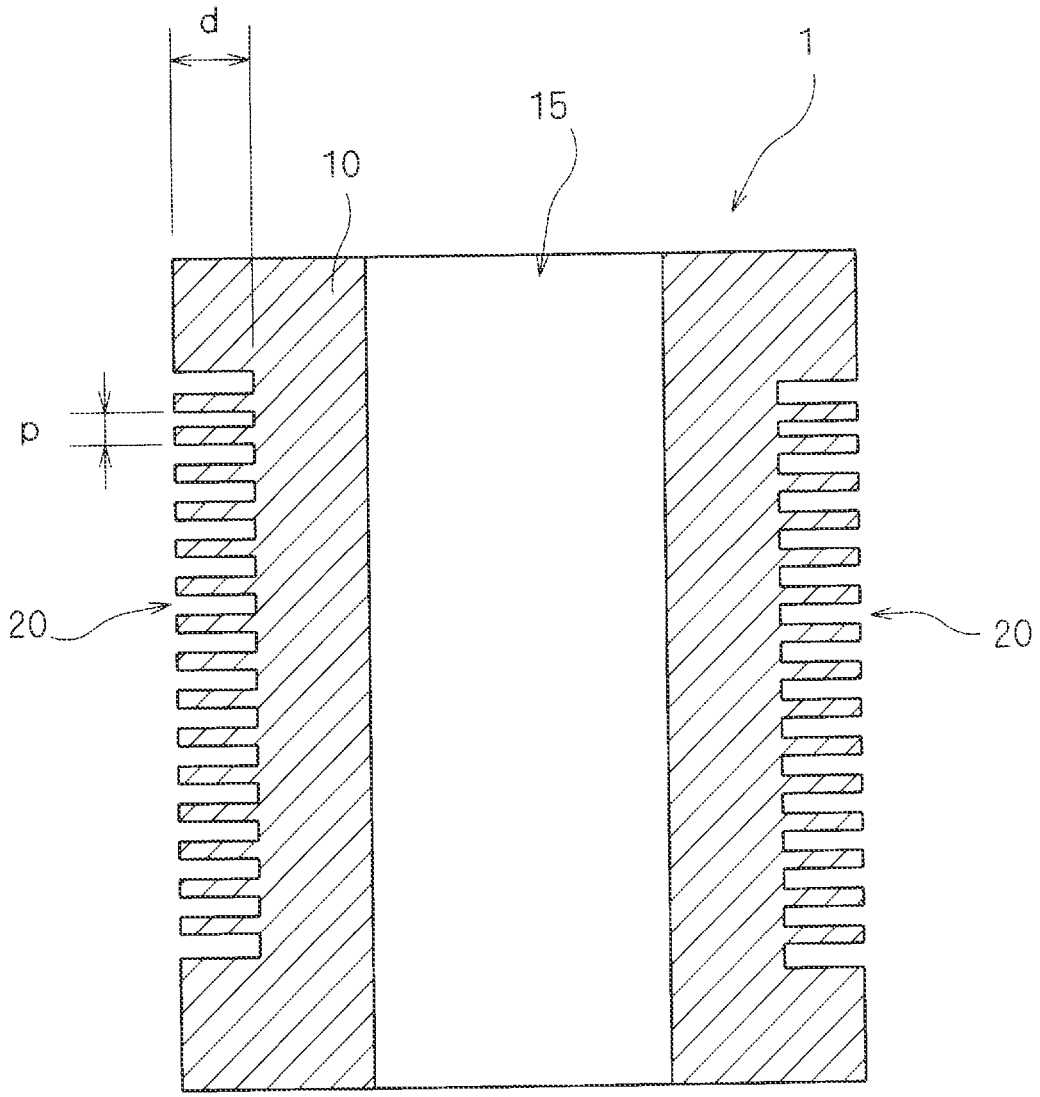
FIG. 2 is a longitudinal sectional view of the heat treatment jig shown in FIG. 1.

FIG. 1 is a perspective view showing the overall outer appearance of a heat treatment jig according to the present invention. FIG. 2 is a longitudinal sectional view of the heat treatment jig shown in FIG. 1. Note that in FIG. 1 and subsequent drawings, the dimensions and numbers of respective portions are exaggerated or simplified as needed for easy understanding.

A heat treatment jig 1 is formed by engraving a groove 20 in the outer surface of a tubular body 10 having a hollow cylindrical shape. A metal wire such as a silver wire (Ag) as a heat treatment target is wound along the groove 20. The tubular body 10 need not have a specific size and can have an appropriate size in accordance with the size of the space to accommodate a heat treating furnace. In this embodiment, the cylindrical tubular body 10 has an outer diameter of ϕ50 mm and a height of 120 mm.

The tubular body 10 has a cylindrical hollow portion 15 that is coaxial to the axis of the tubular body. In this embodiment, the diameter of the hollow portion 15 (that is, the inner diameter of the tubular body 10) is ϕ42 mm. Note that the hollow portion 15 is not an indispensable element, and the tubular body 10 may be solid cylinder.

As the material of the tubular body 10, a ceramic containing little impurity and having a heat resistance, for example, alumina (aluminum oxide: $Al_2O_3$) or silica (silicon dioxide: $SiO_2$) is usable. In this embodiment, the tubular body 10 is formed from alumina. Note that when using silica, pure quartz is preferably employed. When a machinable ceramic (free-cutting ceramic) of good workability is used as the material of the tubular body 10, the groove 20 can easily be engraved.

The groove 20 is helically engraved in the outer surface of the cylindrical tubular body 10 along the circumferential direction. In this embodiment, an engraving pitch p of the groove 20 is 0.5 mm. The pitch p is the interval of the helically engraved grooves 20, and corresponds to the distance between the centers of the grooves 20 adjacent along the height direction of the tubular body 10. As shown in FIG. 2, the plurality of grooves 20 are provided in the sectional view. However, they form one groove 20 helically engraved in the outer surface of the tubular body 10. The groove 20 is helically engraved at the pitch p=0.5 mm in the cylinder outer surface having a length of 110 mm except 5 mm at each end of the tubular body 10 having a height of 120 mm.

As shown in FIG. 2, the pitch p is the sum of the width of the groove 20 and the width of the wall that partitions the adjacent grooves 20. Hence, the width of the groove 20 is smaller than the pitch p, as a matter of course. In this embodiment, the width is 0.3 mm. The width of the wall that partitions the adjacent grooves 20 is 0.2 mm. Note that the width of the groove 20, the width of the wall that partitions the adjacent grooves 20, and the engraving pitch p of the groove 20 are not limited to the examples of this embodiment, and can be set to appropriate values. The smaller the pitch p is, the longer the total length of the groove 20 can be. For this reason, the metal wire that can be wound around the heat treatment jig 1 can also be made long. However, the widths of the groove 20 and the wall need to be smaller. The width of the groove 20 needs to be at least larger than the diameter of the metal wire to be wound. When the width of the wall that partitions the adjacent grooves 20 is too small, the strength of the wall may lower, and the wall may break. Hence, it is preferable to decide the pitch p and the widths of the groove 20 and the wall suitable for the purpose of the heat treatment in consideration of these points as a whole.

In this embodiment, a depth d of the groove 20 is 1.0 mm. The one-round length of the groove 20 along the circumferential direction of the cylindrical tubular body 10 having a diameter of ϕ50 mm is about 155 mm. For example, when a silver wire having a length of 155 mm is heated from room temperature (about 20° C.) to 800° C. that is a heat treatment temperature, the silver wire extends by about 2.3 mm due to thermal expansion because the coefficient of thermal expansion of silver is $18.9\times10^{-6}\cdot K^{-1}$. Hence, the diameter of the silver wire wound along the groove 20 increases by about 0.73 mm at the time of heating. Since the depth d=1.0 mm of the groove 20 is larger than this value, the silver wire heated to the heat treatment temperature and thermally expanded is prevented from disengaging from the groove 20 and adhering to the adjacent silver wire. As described above, the depth d of the groove 20 needs to be larger than the isolation length between the metal wire and the groove 20 when the metal wire, which is wound along the groove 20 at room temperature, is heated to a predetermined heat treatment temperature and thermally expanded.

When a metal wire is wound around the heat treatment jig 1 having the above arrangement and heat-treated, adhesion of the metal wires do not occur, even if it deforms to some extent due to thermal expansion. It is therefore possible to prevent adhesion of the metal wires at the time of heat treatment. Especially, when a thin wire having a diameter of ϕ0.5 mm or less, which is difficult to separate once adhesion of the metal wires occurs, undergoes a heat treatment for a long time, the heat treatment jig 1 according to the present invention produces a remarkable effect to prevent adhesion of the thin metal wires. A heat treatment technique using the heat treatment jig 1 will be explained below.

Figure 3:
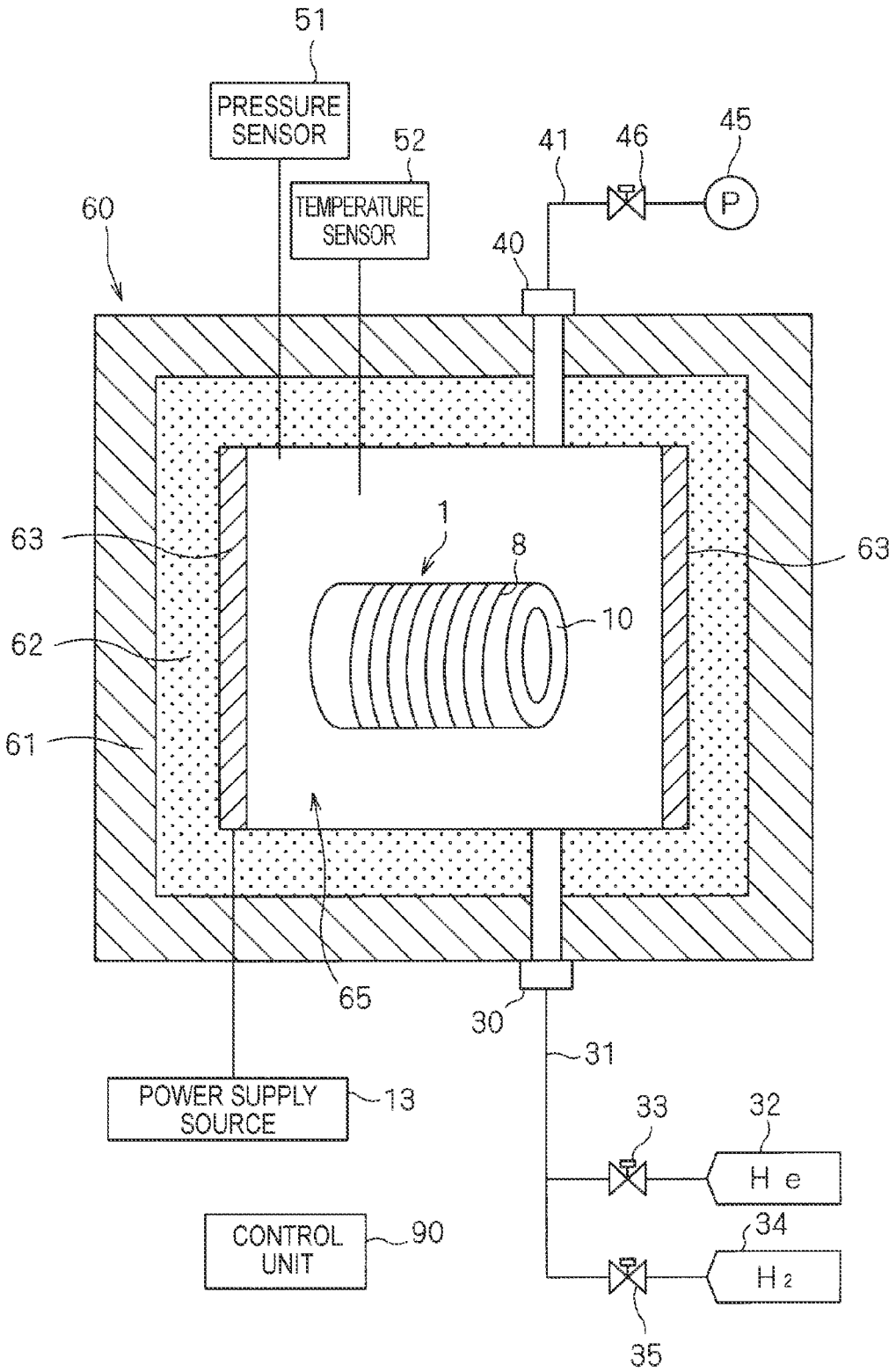
FIG. 3 is a view showing the arrangement of a heat treatment apparatus using the heat treatment jig shown in FIG. 1.

FIG. 3 is a view showing the arrangement of a heat treating furnace 60 to which the heat treatment jig 1 is applied. The heat treating furnace 60 is a vacuum furnace that performs a heat treatment of a sample in a vacuum atmosphere or a predetermined gas atmosphere. The heat treating furnace 60 is formed by providing an electric furnace 62 in a casing 61. Heating elements 63 are provided on the side walls of the electric furnace 62. A space surrounded by the heating elements 63 is a heat treatment space 65. The heat treatment jig 1 can be accommodated in or removed from the heat treatment space 65 via a door (not shown). In this embodiment, the heat treatment jig 1 with a silver wire wound around it is accommodated in the heat treatment space 65.

The heating elements 63 are connected to a power supply source 13 via a power line. The heating elements 63 generate heat upon receiving power from the power supply source 13, and heat the heat treatment space 65. A control unit 90 controls the electric energy to be supplied from the power supply source 13 to the heating elements 63.

The heat treating furnace 60 is provided with an air supply port 30 configured to supply a gas into the heat treatment space 65, and an exhaust port 40 configured to exhaust air from the heat treatment space 65. The air supply port 30 is connected to a helium supply device 32 and a hydrogen supply device 34 so as to communicate with them via an air supply line 31. More specifically, the distal end of the air supply line 31 is connected to the air supply port 30, and the proximal end is divided into two branches. One of the branches is connected to the helium supply device 32, and the other is connected to the hydrogen supply device 34. A helium valve 33 is inserted between the helium supply device 32 and the branch point of the air supply line 31. A hydrogen valve 35 is inserted between the hydrogen supply device 34 and the branch point.

The helium supply device 32 and the hydrogen supply device 34 are formed from, for example, cylinders of helium gas (He) and hydrogen gas ($H_2$) and supply the helium gas and hydrogen gas, respectively. When the helium valve 33 is opened, the helium gas is supplied from the air supply port 30 to the heat treatment space 65. When the hydrogen valve 35 is opened, the hydrogen gas is supplied from the air supply port 30 to the heat treatment space 65. A gas mixture of helium gas and hydrogen gas can also be supplied to the heat treatment space 65 by opening both valves. Note that the control unit 90 may control opening/closing of the helium valve 33 and the hydrogen valve 35.

On the other hand, the exhaust port 40 is connected to a vacuum pump 45 via an exhaust line 41. An exhaust valve 46 is inserted midway through the path of the exhaust line 41 from the exhaust port 40 to the vacuum pump 45. When the vacuum pump 45 is actuated, and the exhaust valve 46 is opened, the atmosphere in the heat treatment space 65 can be exhausted from the exhaust port 40. In addition, when the vacuum pump 45 is actuated, and the air is exhausted from the exhaust port 40 without supplying air from the air supply port 30, the heat treatment space 65 can be set to a vacuum atmosphere. Note that, for example, a rotary pump is usable as the vacuum pump 45.

The atmospheric pressure in the heat treatment space 65 is measured by a pressure sensor 51. The temperature in the heat treatment space 65 is measured by a temperature sensor 52. The pressure and temperature in the heat treatment space 65, which are measured by the pressure sensor 51 and the temperature sensor 52, are transmitted to the control unit 90.

The control unit 90 controls the above-described various operation mechanisms provided in the heat treating furnace 60. The arrangement of the control unit 90 as hardware is the same as that of a general computer. More specifically, the control unit 90 includes a CPU that performs various kinds of arithmetic processing, a ROM that is a read only memory for storing basic programs, a RAM that is a freely readable/writable memory for storing various kinds of information, and a magnetic disk that stores control software, data, and the like. Processing in the heat treating furnace 60 progresses as the CPU of the control unit 90 executes a predetermined control program. More specifically, while monitoring the state in the heat treatment space 65 by the pressure sensor 51 and the temperature sensor 52, the control unit 90 controls electric energy from the power supply source 13, opening/closing of the helium valve 33, the hydrogen valve 35, and the exhaust valve 46, and the like based on the measurement result.

When performing a heat treatment of a metal wire in the heat treating furnace 60 having the above-described arrangement, first, a metal wire as a heat treatment target is wound around the heat treatment jig 1. In this embodiment, a silver wire 8 is wound along the helical groove 20 of the heat treatment jig 1. This winding operation is performed using a winding machine or the like in a state in which the heat treatment jig 1 is extracted from the heat treating furnace 60.

The diameter of the silver wire 8 wound around the heat treatment jig 1 is smaller than the width of the groove 20, and is ϕ300 μm or less. Silver is a precious metal having an FCC structure (face-centered cubic structure), and its electric conductivity is higher than that of copper (Cu). In addition, silver has excellent ductility and malleability. Note that the silver wire need not be wound along the full length of the helical groove 20, and is wound through a necessary length.

After completion of the winding process of winding the silver wire 8 along the groove 20 of the heat treatment jig 1, the heat treatment jig 1 with the silver wire 8 wound around it is installed in the heat treatment space 65 of the heat treating furnace 60 such that the axial direction is set along the horizontal direction. The heat treatment space 65 is set to, for example, a helium gas atmosphere. Power supply from the power supply source 13 to the heating elements 63 is started to heat the heat treatment space 65. The heat treatment jig 1 placed in the heat treatment space 65 and the silver wire 8 wound around it are heated to a predetermined heat treatment temperature (for example, 800° C. that is equal to or higher than the recrystallization temperature of silver and equal to or lower than the melting point of silver).

The silver wire 8 heated to the heat treatment temperature extends due to thermal expansion. However, since the silver wire 8 is heated in a state in which it is wound along the groove 20, the silver wires 8 do not adhere to each other, and adhesion of the silver wires 8 at the time of heat treatment can be prevented. In particular, the depth d of the groove 20 is larger than the isolation length between the silver wire 8 and the groove 20 when the silver wire 8, which is wound along the groove 20 at room temperature, is heated to the heat treatment temperature and thermally expanded. This makes it possible to reliably prevent the silver wire 8 thermally expanded at the time of heat treatment from disengaging from the groove 20 and adhering to the neighboring silver wire 8.

After the heating process of heating the silver wire 8 to the heat treatment temperature and holding it for a predetermined time, the output of the heating elements 63 is decreased to cool the heat treatment space 65. Accordingly, the temperature of the heat treatment jig 1 and the silver wire 8 also lowers. After the heat treatment space 65 cools to a predetermined value or less, the heat treatment jig 1 is extracted from the heat treatment space 65. When the silver wire 8 is removed from the heat treatment jig 1, a product after the heat treatment can be obtained. Note that the heat treatment conditions such as the heating and cooling speeds of the silver wire 8, the holding time at the heat treatment temperature, and the atmosphere in the heat treatment space 65 can appropriately be set in accordance with the purpose of the heat treatment.

Figure 4:
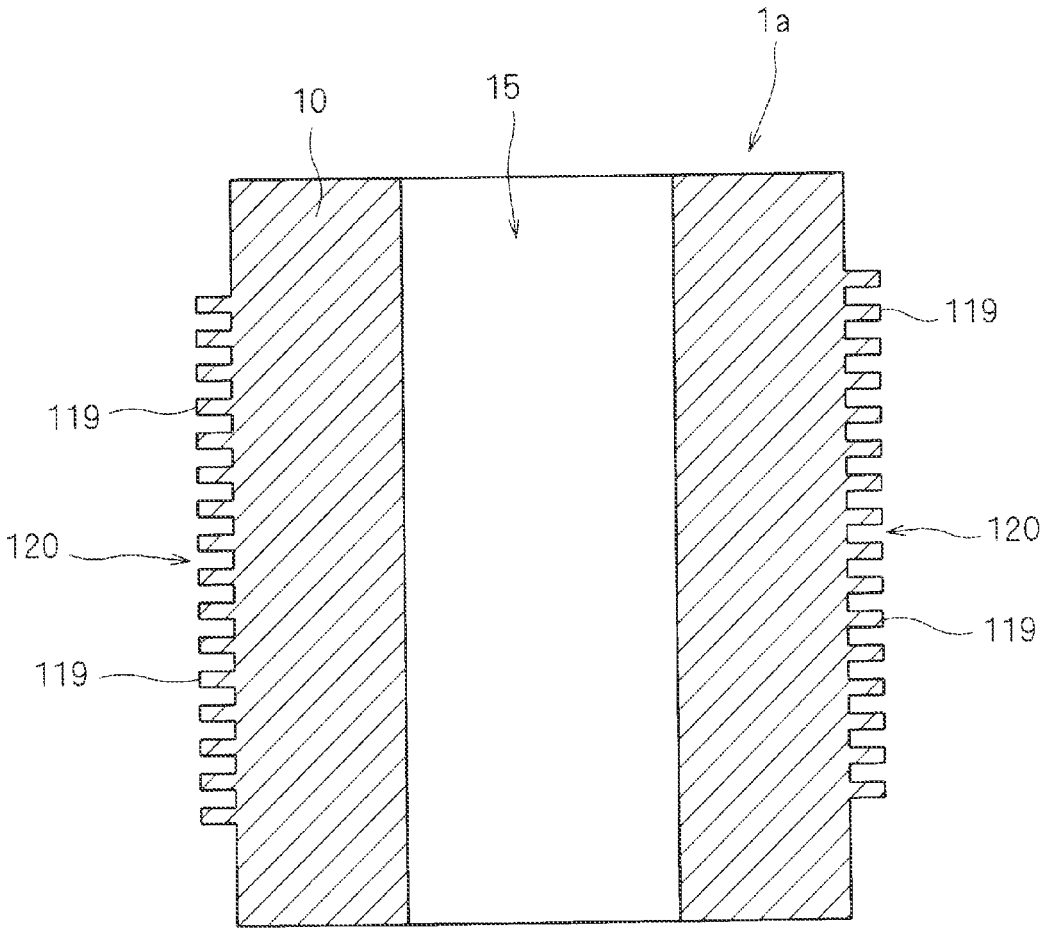
FIG. 4 is a longitudinal sectional view showing another example of the heat treatment jig.

The embodiment of the present invention has been described above. However, in addition to the above-described embodiment, various changes and modifications can be made without departing from the spirit and scope of the present invention. For example, in the above embodiment, the groove 20 is helically engraved in the outer surface of the cylindrical tubular body 10. Instead, a groove may be formed by forming a partition wall on the outer surface of the tubular body 10. FIG. 4 is a longitudinal sectional view showing another example of the heat treatment jig. The same reference numerals as in FIG. 1 denote the same elements in FIG. 4.

In a heat treatment jig 1*a* shown in FIG. 4, a partition wall 119 is helically formed on the outer surface of the tubular body 10 having a hollow cylindrical shape. As a result, grooves 120 are formed between the adjacent partition walls 119, and the groove 120 is helically formed on the outer surface of the tubular body 10, as in the above-described embodiment. In the heat treatment jig 1*a*, the formation pitch of the partition wall 119 equals the pitch of the groove 120. Hence, when the formation pitch of the partition wall 119 is 0.5 mm, the pitch of the groove 120 is 0.5 mm, as in the above-described embodiment. In the heat treatment jig 1*a*, the formation height of the partition wall 119 equals the depth of the groove 120. Hence, when the formation height of the partition wall 119 is 1.0 mm, the depth of the groove 120 is 1.0 mm, as in the above-described embodiment. Even when a metal wire is wound around the heat treatment jig 1*a* and heat-treated, adhesion of the metal wires at the time of heat treatment can be prevented, as in the above-described embodiment.

The shape of the tubular body 10 is not limited to the cylindrical shape, and may be a polygonal prism shape. When the groove 20 is helically formed in the outer surface of the tubular body 10 having the polygonal prism shape, the same effects as in the above-described embodiment can be obtained.

The metal wire wound around the heat treatment jig according to the present invention and heat-treated is not limited to a silver wire, and may be a wire of another metal material such as a copper wire (Cu), an aluminum wire (Al), or a gold wire (Au). Even when such a metal wire is wound around the heat treatment jig according to the present invention and heat-treated, adhesion of the metal wires can be prevented.

The arrangement of the heat treating furnace 60 in which the heat treatment jig according to the present invention is installed is not limited to the example shown in FIG. 3. For example, a mechanism configured to apply a strong electric field to the back sides of the heating elements 63 may be added. The heat treating furnace 60 is not limited to an electric furnace that heats a metal wire by the heating elements 63. For example, a metal wire may be heated by another method such as high-frequency heating or light irradiation heating. The heat treatment jig according to the present invention can be installed in such a furnace. The heat treating furnace 60 of the above embodiment is a so-called batch furnace that heat-treats a metal wire wound around the heat treatment jig 1 at once. However, the heat treating furnace 60 may be a so-called continuous furnace that has a plurality of heat treatment zones and can perform a heat treatment continuously while conveying the heat treatment jig 1 with a metal wire wound around it through the plurality of heat treatment zones.

In the above-described embodiment, the heat treatment space 65 is set to a helium gas atmosphere. Instead, an atmosphere of another inert gas, for example, argon gas may be formed.

The heat treatment jig according to the present invention can suitably be used for a heat treatment of metal wires such as a bonding wire of a semiconductor chip, a wire material of the power supply system of an automobile, an audio cable, and a wire material of medical equipment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A metal wire heat treatment method comprising:

a winding step of winding a silver wire along a groove of a heat treatment jig;

a heating step of installing the heat treatment jig with the silver wire wound in a heat treating furnace and heating the silver wire to a predetermined heat treatment temperature, which is from a recrystallization temperature of silver to a melting point of silver; and a removing step of removing the silver wire from the heat treatment jig, wherein the heat treatment jig includes a cylindrical tubular body, wherein an outer wall surface of the cylindrical tubular body has a helical groove formed along a circumferential direction to wind the silver wire, wherein a depth of the groove is larger than a length at which the silver wire will isolate from the groove when the silver wire wound along the groove at room temperature is thermally expanded by being heated to the predetermined heat treatment temperature, wherein the groove has a rectangular cross-sectional shape and includes a pair of side walls, which are parallel with each other, and wherein a width between the pair of side walls is larger than a diameter of the silver wire.

2. The method according to claim 1, further comprising a cooling step of cooling the heat treatment jig with the silver wire after the heating step and before the removing step.

3. The method according to claim 1, wherein the cylindrical tubular body is made of alumina or silica.

4. The method according to claim 1, wherein the diameter of the silver wire is 0.5 mm or less.

5. The method according to claim 1, wherein a ratio of the depth of the groove to an outer diameter of the cylindrical tubular body is at least 0.02.

* * * * *